US008105176B2

(12) United States Patent
Upenieks

(10) Patent No.: US 8,105,176 B2
(45) Date of Patent: Jan. 31, 2012

(54) BREAK COMPENSATING GOLF CLUB HEAD

(76) Inventor: John Andrew Upenieks, Toronto (CA)

( * ) Notice: Subject to any disclaimer, the term of this patent is extended or adjusted under 35 U.S.C. 154(b) by 18 days.

(21) Appl. No.: 12/683,042

(22) Filed: Jan. 6, 2010

(65) Prior Publication Data

US 2011/0165962 A1 Jul. 7, 2011

(51) Int. Cl.
*A63B 69/36* (2006.01)
*A63B 53/04* (2006.01)

(52) U.S. Cl. ..... 473/251; 473/330; 473/340

(58) Field of Classification Search ..... 473/219–256, 473/324–350; D21/736–746, 751, 759
See application file for complete search history.

(56) References Cited

U.S. PATENT DOCUMENTS 3,043,596 A * 7/1962 Ehmke ..... 473/240
3,392,977 A * 7/1968 De Lacey ..... 473/306
3,489,415 A * 1/1970 Smith ..... 473/236
3,819,180 A * 6/1974 Murphy ..... 473/313
3,989,256 A * 11/1976 Cicero ..... 473/252
3,989,257 A 11/1976 Barr
4,413,825 A * 11/1983 Sasse ..... 473/331
4,422,638 A 12/1983 Tucker
4,664,385 A 5/1987 Macera
4,867,457 A 9/1989 Lowe
4,919,424 A 4/1990 Fukumochi et al.
5,167,414 A * 12/1992 Montgomery, III ..... 473/251
5,333,873 A * 8/1994 Burke ..... 473/252
5,382,019 A 1/1995 Sneed
D381,382 S * 7/1997 Fenton, Jr. ..... D21/743
5,746,665 A 5/1998 Wenker
5,759,114 A 6/1998 Bluto et al.
5,769,738 A 6/1998 Kershaw et al.
5,857,920 A * 1/1999 Hong ..... 473/240
5,871,407 A 2/1999 Tseng
6,155,933 A 12/2000 Schmitt
6,244,974 B1 * 6/2001 Hanberry, Jr. ..... 473/242
6,951,517 B2 * 10/2005 Lindsay ..... 473/313
7,294,066 B1 11/2007 Richard, Jr.
7,335,112 B1 2/2008 Bitondo
7,367,896 B2 5/2008 Jackson
7,850,538 B1 * 12/2010 Yoon ..... 473/251
2006/0009305 A1 1/2006 Lindsay
2007/0087859 A1 4/2007 Thorn
2007/0155524 A1 7/2007 Cameron
2008/0161121 A1 7/2008 Bitondo (Continued)

OTHER PUBLICATIONS

Photocopy of p. 39 of the book "How I Play Golf" by Woods, Tiger, published by Warner Books, Inc. On Oct. 8, 2001 and Sep. 1, 2004.

(Continued)

*Primary Examiner* — Sebastiano Passaniti

(57) ABSTRACT

A head for a golf club, such as a putter, having a bottom surface, a heel end, a toe end and a striking face. The striking face has a planar primary portion and a secondary portion each extending from one of the two ends and meeting at an intermediate point. Each point along the striking face has a normal direction extending normally outwardly from the striking face relative to a plane tangential to the striking face at that point. The normal direction to each point on the secondary portion is directed away from the toe end. Striking a ball off of the secondary portion imparts an additional angle to the trajectory of the ball to compensate for the tendency of right-handed golfers to let the club head drift or angle when attempting left-to-right breaking putts.

14 Claims, 6 Drawing Sheets

U.S. PATENT DOCUMENTS

| | | | |
|---|---|---|---|
| 2008/0194352 | A1 | 8/2008 | Cokewell |
| 2008/0207350 | A1 | 8/2008 | Jung |
| 2009/0088268 | A1 | 4/2009 | Elizondo |

OTHER PUBLICATIONS

Printout of an extract from a United States Golf Association Internet web page by the USGA, "Rules and Decisions—Appendix II—Design of Clubs" available at the URL: http://www.usga.org/bookrule.aspx?id=14323 accessed on Dec. 23, 2009.

Printout of an Internet web page by Pelz, Dave, "Farnsworth Diagrams" available at the URL: http://www.usatt.org/rseguine/Pelz/famsworth.html accessed Dec. 23, 2009.

Printout of an About.com Internet web page by Kelley, Brent, "Loft—Definition of Loft" available at the URL: http://golf.about.com/cs/golfterms/g/bldef_loft.htm accessed on Nov. 10, 2009.

Printout of a New York Times Internet web page by Pennington, Bill, "Golf—Even With the Putter, Loft is a Consideration" available at the URL: http://www.nytimes.com/2009/06/22/sports/golf/22golfputter.html?_r=1 published Jun. 21, 2009 accessed Dec. 23, 2009.

Photocopy of a newspaper article by Allen, Charlie, "Sleeper club out-putts eleven of golf's best in New England contest." appearing in The Ottawa Citizen, Jul. 30, 2009 on p. E8.

* cited by examiner

BREAK COMPENSATING GOLF CLUB HEAD

RELATED APPLICATIONS

Not applicable.

FIELD OF THE INVENTION

The present disclosure relates to a golf club, in particular a putter head.

BACKGROUND OF THE INVENTION

Golf is a sport in which players direct a ball from a teeing ground into a target hole by a stroke or successive strokes of a club. As is well known in the art, a golf club consists of a shaft attached to a head, with the head having a striking face, a bottom surface, a heel end and a toe end. When the shaft is held by a player to attempt a stroke, the bottom surface is flush over the surface of the ground, the heel end of the head is proximate the player, the toe end points away from the player and the striking face is aligned to impact the golf ball when the club is swung or moved by the player. The distance and arc of the trajectory of the ball after it is struck depends on the loft of the striking face of the club selected. Loft is the angle at which the surface of the striking face lies relative to a perfectly vertical striking face.

In one version of golf, the player requiring the fewest strokes to complete 18 holes is declared the winner. In a number of forms of the game of golf, putting accounts for almost half of the strokes taken by a player.

The region immediately surrounding the target hole is known as the putting green. The putting green is typically a well maintained, close cropped and relatively smooth surface that may have undulating slope. Typically, each stroke with a lofted club directs the ball in an arc-shaped trajectory closer towards, and ultimately into, the target hole. When the ball is on the putting green, a player typically uses a club known as a putter to direct the ball into the target hole. A putter has little loft so that the putted ball rolls along the surface of the putting green rather than taking an arc-shaped trajectory. Fewer strokes may be achieved by accurately directing a ball on the green toward the target hole in accordance with the undulations of the green.

When a golf ball is on the green without any slope transverse to, or left or right of, the direct line between the ball and the target hole, the aiming line for the putt will be the direct line to the target hole and the putter head is squared to the line at impact.

One of the more difficult putts a right handed player can attempt is known as a left-to-right breaking putt (while the converse is equally true for a left handed player attempting a right-to-left breaking putt, for simplicity of explanation the present disclosure will be described in the context of a right handed player and a left-to-right breaking putt, recognizing that such disclosure would readily be adapted to accommodate a left-handed player).

In a left-to-right breaking putt, when a player stands behind the ball directly facing the hole, some segment of the surface of the green on the player's left-hand side is elevated relative to the surface of the green along the direct line between the ball and the hole. In such a context, if the direction of aim is the direct line towards the hole, after the ball is struck, gravity will cause the trajectory of the ball to break down the slope, away from, and to the right of, the trajectory along which the ball was directed. Such effects may be compensated for by increasing the force with which the ball is struck or by aiming the ball to the left of the hole.

However, even if such errors are eradicated so that the physics of alignment and force are correctly determined, the execution by the player may be inadequate. It is recognized that the player often has a tendency to let the club head drift or angle to the right (toward the hole) through impact when putting a left-to-right breaking putt, thus missing to the right of the target hole. This problem has been commonly referred to as missing on the "amateur side" of the hole, i.e. to the right side or "low side" of the hole.

SUMMARY OF THE INVENTION

The present disclosure provides a change in the striking face of the head of a golf club that is not readily apparent to the player to compensate for the tendency to let the club head drift or angle when attempting a left-to-right breaking putt. The change in the striking face is, in some example embodiments, sufficiently subtle that it does not influence the player's perception of the appropriate aim line to make a putt, so as to effect accurate correction.

According to one broad aspect, the invention relates to a head for a golf club including a bottom surface, a heel end, a toe end, and a striking face. The striking face extends between the heel end and the toe end, adjacent to the bottom surface and extending substantially upwards therefrom. The striking face has a substantially planar primary portion and a secondary portion each extending from one of the two ends and meeting at an intermediate point. Each point along the striking face defines a normal direction that extends normally outwardly from the striking face relative to a plane tangential to the striking face at such point. The normal direction to each point on the secondary portion is directed away from the toe end.

According to a further broad aspect, the invention relates to a putter including an elongate shaft, a head having a bottom surface, a heel end, a toe end and a striking face. The elongate shaft is disposed toward the heel end of the head. The striking face is adjacent to the bottom surface, extends between the heel and toe ends and is substantially upward from the bottom surface. The striking face has a substantially planar primary portion and a secondary portion. The secondary portion extends from the heel end to an intermediate point and the primary portion extends from the intermediate point to the toe end. Each point along the striking face defines a normal direction that extends normally outwardly from the striking face relative to a plane tangential to the striking face at such point. The normal direction to each point on the secondary portion is directed away from the toe end.

BRIEF DESCRIPTION OF THE DRAWINGS

The embodiments of the present disclosure will now be described by reference to the following figures. The Figures are provided for illustrative purposes only and have not been drawn to scale. Identical reference numerals in different figures indicate identical elements.

DETAILED DESCRIPTION

The present disclosure will now be described for the purposes of illustration only, in conjunction with certain embodiments shown in the enclosed Figures. While preferred embodiments are disclosed, this is not intended to be limiting. Rather, the general principles set forth herein are considered to be merely illustrative of the scope of the present disclosure and it is to be further understood that numerous changes covering alternatives, modifications and equivalents may be made without straying from the scope of the present disclosure, as defined by the appended claims.

In particular, all dimensions described herein are intended solely to illustrate certain embodiments and are not intended to limit the scope of the invention to any embodiments that may depart from such dimensions as may be specified. Again, the figures are not to scale; some features have been exaggerated to facilitate explanation.

Figure 1:
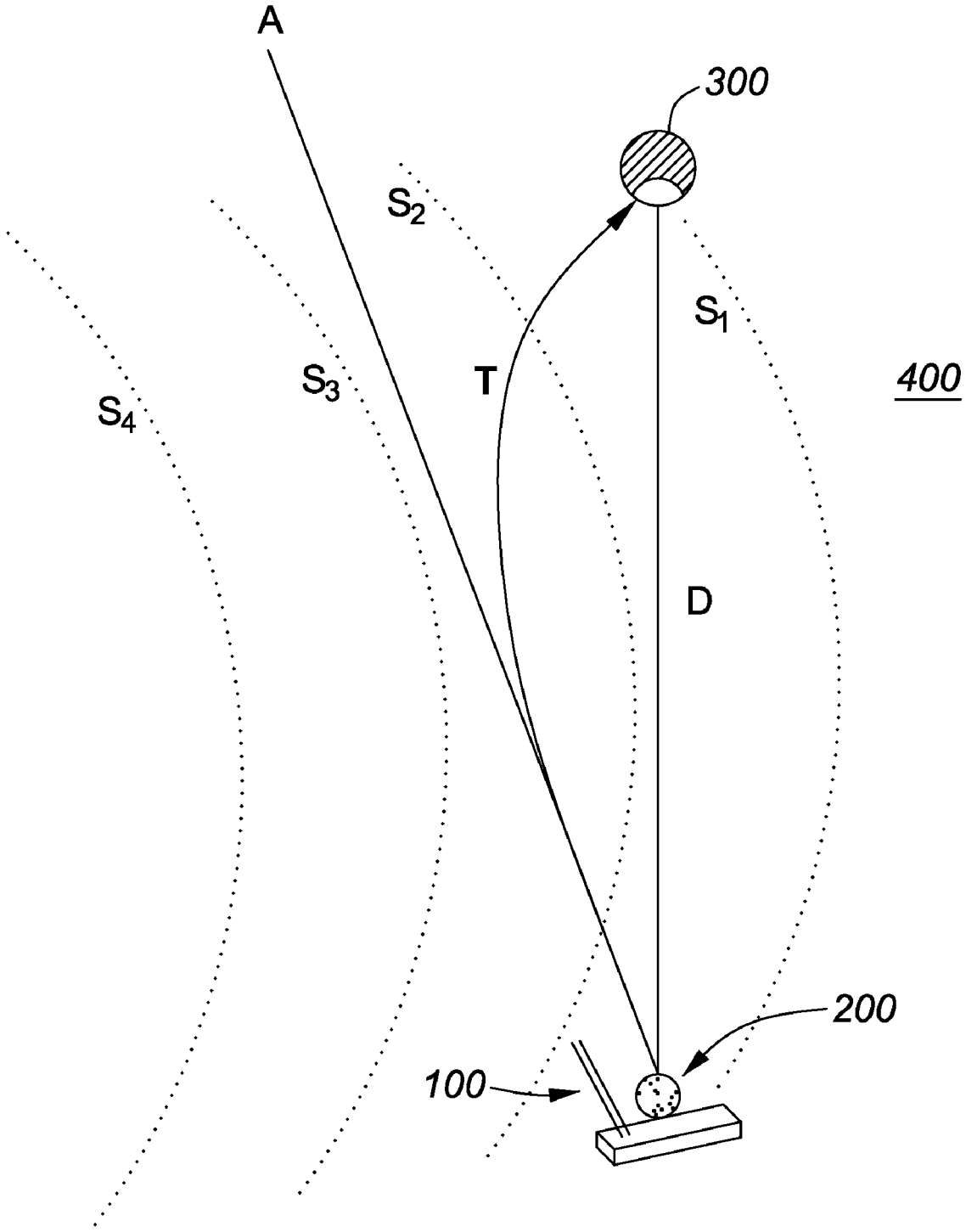
FIG. 1 (PRIOR ART)
FIG. 1 is a perspective view showing alignment of a right handed golf club in a left-to-right breaking putt.

Turning to FIG. 1, the physics presented to a player facing a left-to-right breaking putt on a green 400 surrounding a target hole 300 are illustrated. The contour lines $S_1$, $S_2$, $S_3$ and $S_4$ illustrate an example of a topographical slope on the surface of the green 400 where the golf ball 200 rests. Direct line D shows the shortest direct path from the ball 200 to the hole 300. In FIG. 1, the surface of the green 400 left of direct line D is elevated relative to direct line D such that the surface of the green 400 is sloped from left-to-right along direct line D. When the ball 200 is struck by the club 100 along a trajectory line T, the ball's line of trajectory would initially be along aim line A, (left of direct line D). However, due to gravity, as the ball 200 rolls along the slope of the surface of the green 400, the ball's trajectory T would break away from aim line A and towards the hole 300.

The angle between aim line A and direct line D defines the apparent angle to compensate for the left-to-right break caused by the left-to-right slope along the path of the trajectory T of the ball 200.

The appropriate amount of force to be imparted to the ball 200 by the club 100 is such that the ball 200 just reaches the hole 300 when travelling along the trajectory T.

Figure 2:
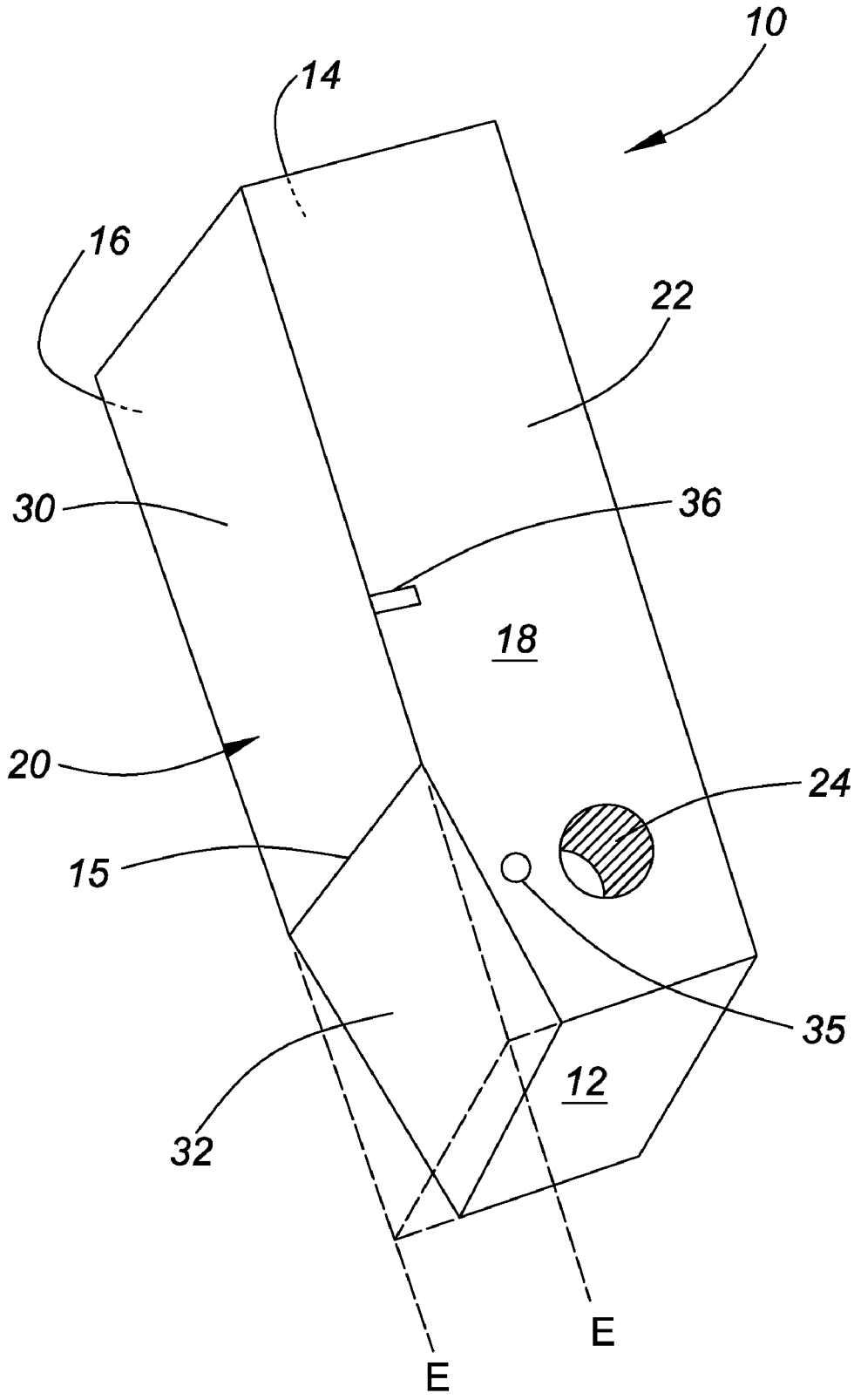
FIG. 2 is a perspective view of an example embodiment for a head for a golf club according to the present disclosure.

Turning to FIG. 2, the head 10 of a golf club according to an example embodiment is defined by a heel end 12, a toe end 14, a bottom face 16, a top face 18, a striking face 20, a back 22 and a bore 24 for accommodating a golf club shaft (not shown).

The heel end 12 lies opposite the toe end 14. The striking face 20 extends between the heel end 12 and the toe end 14 adjacent the bottom surface 16, and substantially upward to the top surface 18. The bottom face 16 is configured so that the head 10 can be easily moved across the surface of the green 400 and the striking face 20 can contact the ball 200 with little or no loft during a stroke.

The striking face 20 has two parts: a substantially planar primary portion 30 and secondary portion 32. The primary portion 30 extends from one end 14 to an intermediate point 15 on the striking face 20 and the secondary portion 32 extends from the other end 12 to the intermediate point 15.

For purposes of the present disclosure, the outward direction that is perpendicular to a plane that is tangential to the striking face 20 at a point on the striking face 20, whether within the primary portion 30 or the secondary portion 32, will be referred to as the normal direction to such point.

The club 100 is said to be "squared" to the ball 200 at impact, if the club is swung so that the direction normal to the point of contact at impact is coincident with aim line A shown in FIG. 1. In such a scenario, the ball 200 will initially proceed upon impact along trajectory line T.

Generally, the primary portion 30 of the striking face 20 would be planar, such that the normal direction along the entirety of the primary portion 30 is constant.

The secondary portion 32 of the striking face 20 is angled relative to the primary portion 30 such that the normal direction to points along the secondary portion 32 is directed away from the toe end of the club 100.

In some example embodiments, the normal direction to each point along the secondary portion 32 would be angled from about 0 to about 5 degrees from the normal direction to each point of the primary portion 30. This approximate range provides additional break compensation when striking a ball along the secondary portion 32, but is small enough that the additional angle is not readily perceived by the player. The additional break compensation counteracts the tendency to let the club head drift to the right (toward the hole) through impact on left-to-right breaking putts. An angle of about 2 to 3 degrees provides a trade-off between compensating for break and influencing the player's perception of the aim line A. However, the above discussed ranges are not limiting; some example embodiments may have points on the secondary portion 32 with angles outside these ranges.

In the example embodiment shown in FIGS. 2 through 5, the primary portion 30 extends from the toe end 14 and the secondary portion 32 extends from the heel end 12 to meet at an intermediate point 15 along the striking face 20. The striking face 20 of this example embodiment is asymmetric from heel end 12 to toe end 14.

Figure 3:
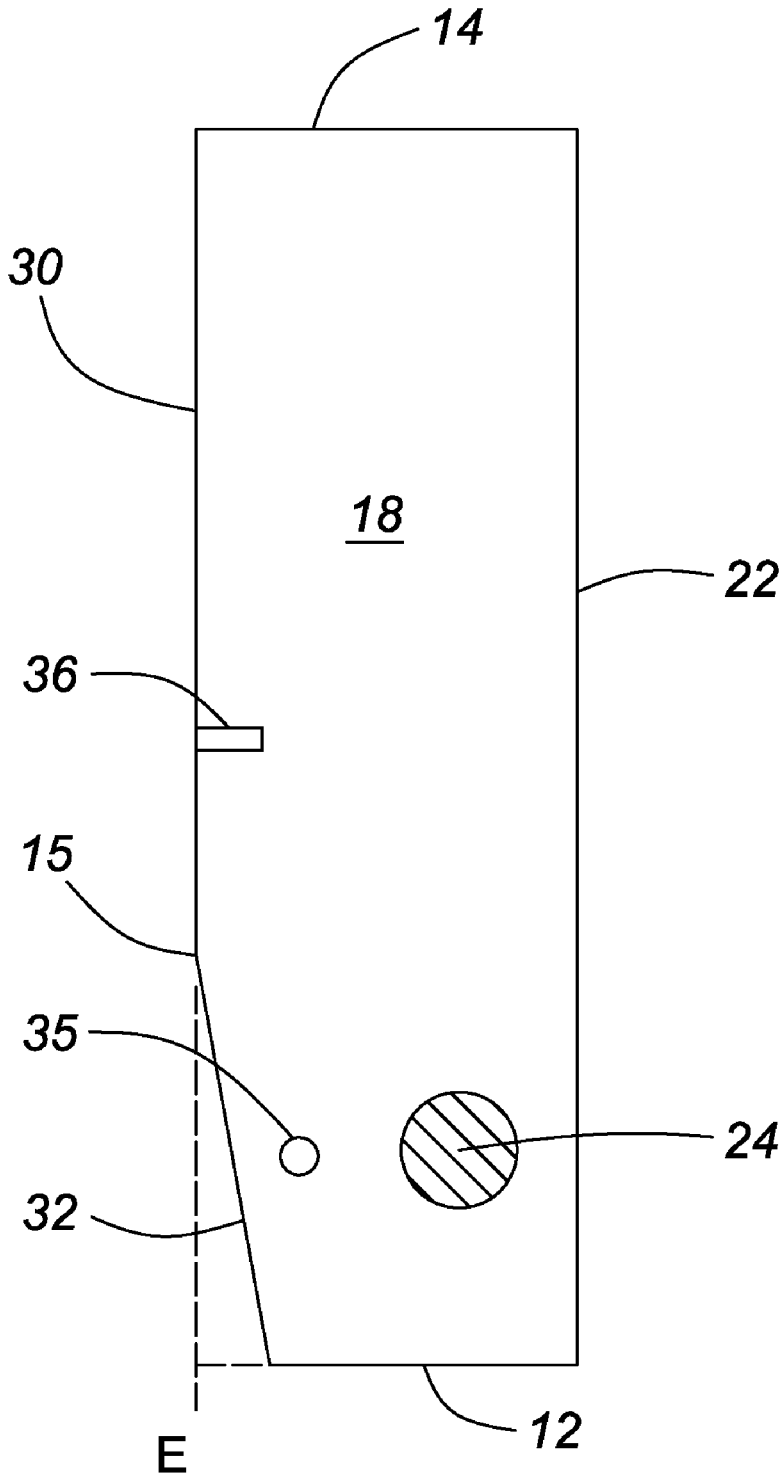
FIG. 3 is a top view of the example embodiment of FIG. 2.

As shown in FIGS. 2 and 3, lines E extend in phantom the plane of the primary portion 30 across the secondary portion 32 to emphasize the wedge-shaped portion that is absent from the head 10. In some example embodiments, the head 10 is fabricated with the secondary portion 32 such as by molding, forging or otherwise pre-forming the desired shape of the striking face. In further example embodiments, the secondary portion 32 is cut, milled, or material is otherwise removed from a head having a striking face without a pre-existing secondary portion. Other methods of forming a head 10 having such secondary portion 32 may be apparent to one skilled in the art.

Figure 4:
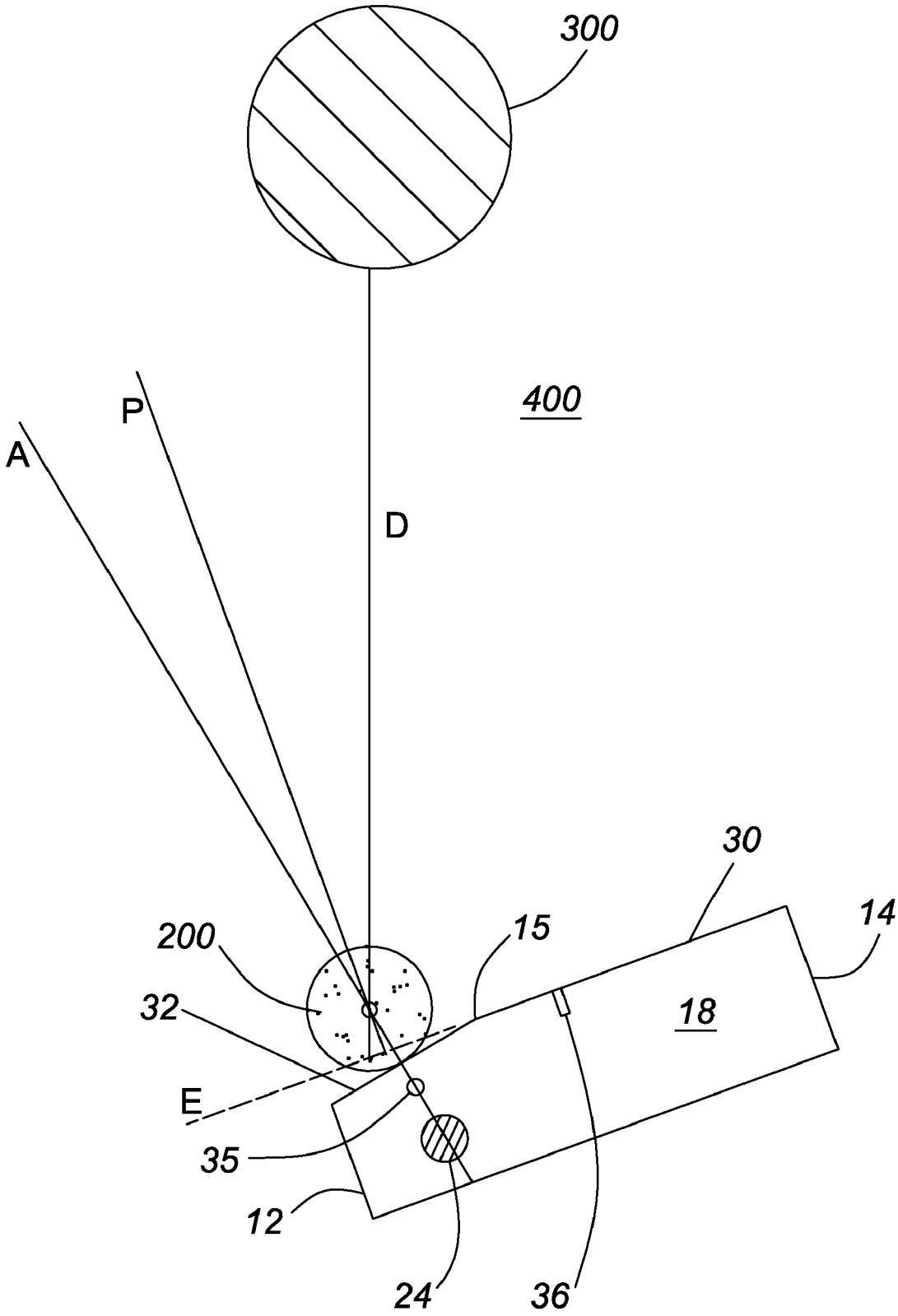
FIG. 4 is a top view showing alignment of the example golf club head of FIG. 2 to make a left-to-right breaking putt.

In the example embodiment shown in FIG. 4, the scenario shown in FIG. 1 is repeated without showing slope lines $S_1$-$S_4$ or trajectory line T. The head 10 is aligned so that the ball 200 will be struck by the secondary portion 32 to provide additional compensation for the left-to-right break. Line E again extends in phantom the plane of the primary portion 30 across the secondary portion 32, illustrating the wedge-shaped part that is absent from the head 10. Because the angle of the points of the secondary portion 32 relative to the plane of the primary portion 30 would be nearly undetectable to the player, the player's perceived aim line P would likely be normal to line E and the plane of the primary portion 30. However, by aligning the ball 200 to be struck along the secondary portion 32, the angle of the aim line A includes an additional angle (between perceived aim line P and aim line A) from the secondary portion 32, compensating for the tendency to let the club head drift or angle towards the hole when attempting a left-to-right breaking putt.

In many golf clubs an alignment mark 36 may be applied on the top surface 18 of the head 10 to provide a centering mechanism and to assist in aiming the ball 200 to be struck off the primary portion 30. In some example embodiments of the present disclosure, a second alignment mark 35 may be placed on the head 10 to provide a centering mechanism and to assist in aiming the ball 200 to be struck off the secondary portion 32. In some example embodiments, mark 35 could be a dot that is located near the midpoint of the secondary portion 32.

Figure 5:
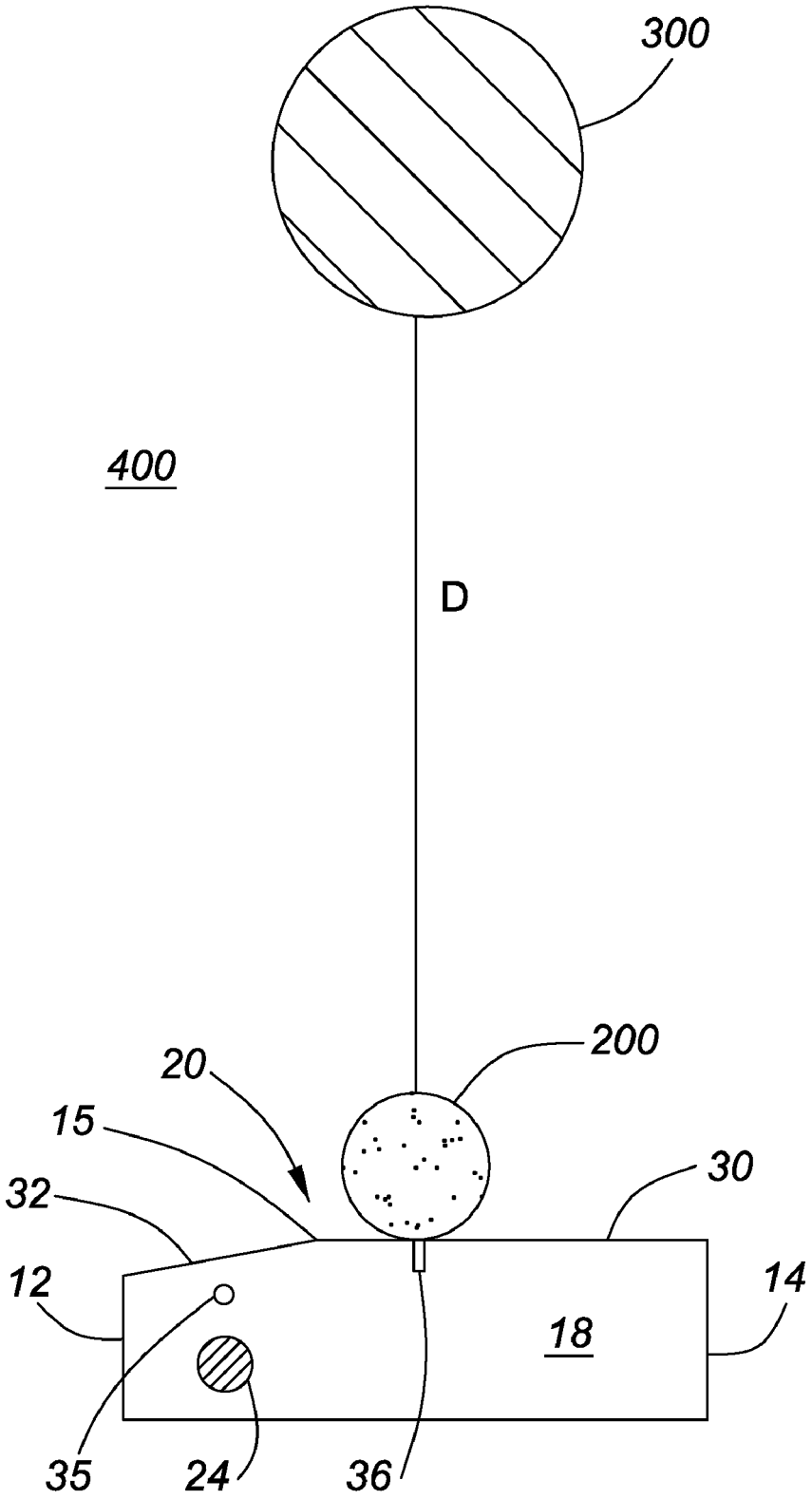
FIG. 5 is a top view showing alignment of the example golf club head of FIG. 2 to make a putt with no break.

In the example embodiment shown in FIG. 5, a golf ball 200 is on the surface of the green 400 near the target hole 300 without any break along the direct line D. As no compensation for a left-to-right break is called for, the ball 200 is aligned off of the primary portion 30. No change is made to the aim line; or in other words, the club shown in FIG. 5 can be used the same as any club without adverse influence from the secondary portion 32. The ball 200 can be aligned using the alignment mark 36 to impact the primary portion 30.

Figure 6:
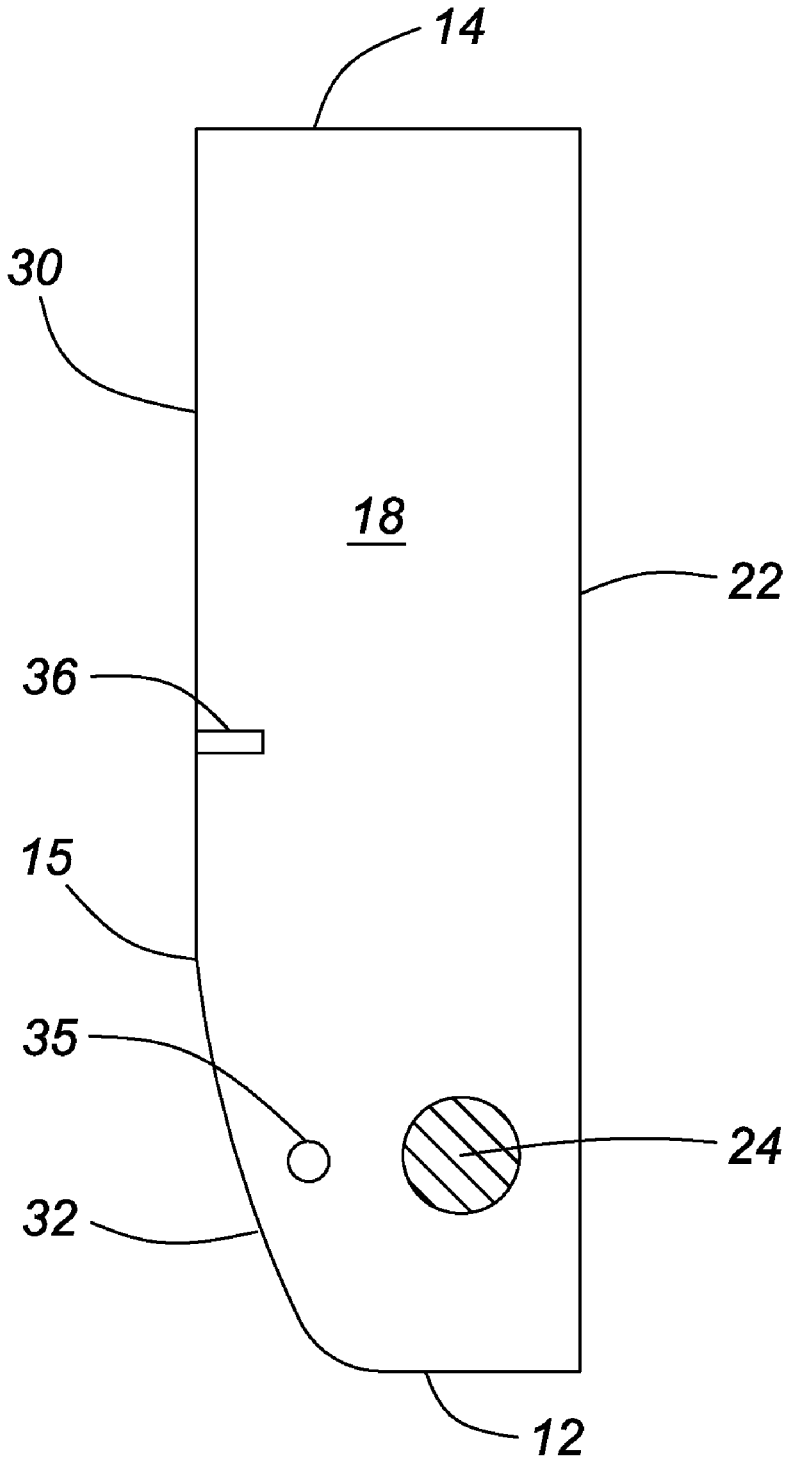
FIG. 6 is a top view of an example embodiment of a head for a golf club according to the present disclosure.

In another example embodiment shown in FIG. 6, the normal direction to points of contact on the secondary portion 32 are not uniformly angled relative to the plane of the primary portion 30. Rather the points of the secondary portion 32 form a curve that gradually increases in angle relative to the plane of the primary portion 30 as the points of the secondary portion 32 extend away from the intermediate point 15 and towards the heel end 12.

In the example embodiment shown in FIG. 6, the points along the secondary portion 32 form an outwardly extending convex curve. In further embodiments of the present disclosure, the points of the secondary portion 32 may have other shapes, for example, but not limited to, concave curves, irregular curves or a combination of curved or irregular or planar segments. For example, several sequential points of the secondary portion 32 may define a plane that is angled about 2 to 3 degrees relative to the normal direction to a point on the primary portion 30.

In some other example embodiments, the points along the secondary portion 32 are formed such that the primary portion 30 and the secondary portion 32 define one smooth striking face 20 such as described by the United States Golf Association Rules (publicly available at the URL http://www.usga.org). For example, the striking face 20 can be substantially planar from the toe end 14 to the intermediate point 15 and convexly curving towards the heel end 12 without discontinuity.

In yet further example embodiments, the points of the secondary portion 32 may be adjustable through a range of angles such as by screw adjustment, selectable preset positions or other means known in the art.

A shaft attachment 24 for connecting a shaft (not shown) to the head 10 is shown in each of FIGS. 2 through 6 as a cylindrical inset into the head 10. Many other methods of attaching a shaft to a head of a golf club are known in the art. The bore 24 is also shown proximate to the heel end 12 and inset into the top surface 18. Again, many different placements of the shaft attachment 24, and the effects of changing the location of the shaft attachment 24 are known in the art. The shaft attachment 24 is not intended to limit the present disclosure.

It will be seen by those skilled in the art that although the present disclosure has been described by way of detailed embodiments thereof, the present disclosure is not limited to the embodiments or elements described in detail herein. The present disclosure includes variations and departures from the elements described herein, and equivalent elements, features and aspects thereto. The full scope of the present disclosure is defined by the specification as a whole, including the claims, and further including functional, mechanical and structural equivalents to the elements described herein.

What is claimed is:

1. A head for a golf club comprising a bottom surface, a heel end, a toe end and a striking face;

the striking face extending between the heel end and the toe end, adjacent the bottom surface and extending substantially upward therefrom;

the striking face having a planar primary portion and a secondary portion each extending from one of the two ends and meeting at an intermediate point that is located adjacent the heel end;

the secondary portion extends from the heel end to the intermediate point and the primary portion extends from the intermediate point to the toe end;

a shaft is attachable to the head proximate to the heel end and rearwardly of the secondary portion;

at address, when the shaft is held by the player to attempt a stroke, the heel end of the head is proximate to the player, the toe end points away from the player;

each point along the striking face having a normal direction extending normally outwardly from the striking face relative to a plane tangential to the striking face at such point;

the normal direction along the entirety of the primary portion is constant;

the secondary portion of the striking face is angled or curved rearwardly relative to the plane of the primary portion;

the normal direction to each point on the secondary portion being directed away from the top end and angled relative to the normal direction to a point on the primary portion.

2. The head according to claim 1, wherein the normal direction to each point on the secondary portion is increasingly angled away from the toe end as the distance of such point from the intermediate point increases.

3. The head according to claim 1, wherein the striking face exhibits no discontinuity therealong.

4. The head according to claim 1, wherein the secondary portion is substantially planar.

5. The head according to claim 1, wherein the secondary portion forms an outwardly extending convex curve.

6. The head according to claim 1, comprising an alignment marking adjacent to a point of the secondary portion, specifically located near the midpoint of the secondary portion.

7. A golf club comprising a head according to claim 1, and an elongate shaft attached to the head proximate the heel end.

8. A golf club according to claim 7, wherein the elongate shaft is angled away from the toe end.

9. A putter comprising a head having a bottom surface, a heel end, a toe end and a striking face;

an elongate shaft attached at one end thereof to the head toward the heel end;

the striking face adjacent the bottom surface and extending between the heel and toe ends and substantially upward from the bottom surface;

the striking face having a planar primary portion and a secondary portion;

the secondary portion extends from the heel end to an intermediate point that is located adjacent the heel end and the primary portion extends from the intermediate point to the toe end;

the secondary portion is proximate to the shaft;

the shaft is attached to the head proximate to the heel end and rearwardly of the secondary portion;

at address, when the shaft is held by the player to attempt a stroke, the heel end of the head is proximate to the player, the toe end points away from the player;

each point along the striking face having a normal direction extending normally outwardly from the striking face relative to a plane tangential to the striking face at such point;

the normal direction along the entirety of the primary portion is constant;

the secondary portion of the striking face is angled or curved rearwardly relative to the plane of the primary portion;

the normal direction to each point on the secondary portion being directed away from the toe end and angled relative to the normal direction to a point on the primary portion.

10. The putter according to claim 9, wherein the normal direction to each point on the secondary portion is increasingly angled away from the toe end as the distance of such point from the intermediate point increases.

11. The putter according to claim 9, wherein the striking face exhibits no discontinuity therealong.

12. The putter according to claim 9, wherein the secondary portion is substantially planar.

13. The putter according to claim 9, wherein the secondary portion forms an outwardly extending convex curve.

14. The putter according to claim 9, comprising an alignment marking adjacent to a point of the secondary portion, specifically located near the midpoint of the secondary portion.

* * * * *